US006155332A

United States Patent [19]

Hödl et al.

[11] Patent Number: 6,155,332

[45] Date of Patent: Dec. 5, 2000

[54] PROCESS FOR CONTINUOUSLY CASTING METAL AND CONTINUOUS CASTING APPARATUS USED THEREOF

[75] Inventors: Heinz Hödl, Leonding; Michael Stiftinger; Andreas Eichinger, both of Linz; Kurt Engel, Florian, all of Austria; Jean-Francois Marioton, Saint Chamas, France; Gerard Zurita, Saint Martin Decrau, France; Vincent Guyot, Pelissanne, France; Catherine Lopes, Metz, France

[73] Assignees: Voest-Alpine Industrieanlagenbau GmbH, Austria; Sollac-Fos, France

[21] Appl. No.: 09/239,389

[22] Filed: Jan. 28, 1999

[30] Foreign Application Priority Data

Nov. 6, 1998 [AT] Austria ..... 1844/98

[51] Int. Cl.[7] ..... B22D 11/041; B22D 11/128

[52] U.S. Cl. ..... 164/459; 164/442; 164/484

[58] Field of Search ..... 164/476, 477, 164/484, 417, 424, 441, 442, 459

[56] References Cited

U.S. PATENT DOCUMENTS

| | | | |
|---|---|---|---|
| 3,290,741 | 12/1966 | Olsson | 164/484 |
| 3,707,180 | 12/1972 | Vogt | 164/484 |
| 4,043,382 | 8/1977 | Saito et al. | 164/476 |
| 4,476,915 | 10/1984 | Rahmfeld et al. | 164/484 |
| 5,853,643 | 12/1998 | Takeuchi et al. | 164/424 X |

FOREIGN PATENT DOCUMENTS

| | | | |
|---|---|---|---|
| 249896 | 10/1966 | Austria . | |
| 331439 | 8/1976 | Austria . | |
| 373518 | 1/1984 | Austria . | |
| 0068814 | 1/1983 | European Pat. Off. . | |
| 56-134054 | 10/1981 | Japan | 164/484 |
| 59-118257 | 7/1984 | Japan | 164/484 |
| 7-223050 | 8/1995 | Japan . | |

OTHER PUBLICATIONS

Abstract of Japanese Patent Publication 56–14063 Published Feb. 10, 1981.

*Primary Examiner*—J. Reed Batten, Jr.
*Attorney, Agent, or Firm*—Ostrolenk, Faber, Gerb and Soffen, LLP

[57] ABSTRACT

In a process for continuously casting a metal strand by casting metal into a straight, vertically oriented mold and subsequently drawing off the strand formed in the mold, the straight strand at first is bent into a circular arc shape in a bending zone along a transition curve, is guided along a circular arc guide and finally is straightened in a final straightening zone along a transition curve and, after this, is extracted via an approximately horizontal straight guide. In order to provide, departing from a continuous casting apparatus including a curved mold, an apparatus including a straight mold while applying as large a number as possible of components of the continuous casting apparatus including the curved mold, it is proceeded in the following manner: The straight strand emerging from the mold in at least one bending zone along a transition curve is bent into a circular arc shape having a first radius and in at least one consecutively arranged straightening zone along a transition curve is bent into a circular arc shape having a larger radius than the first radius.

25 Claims, 1 Drawing Sheet

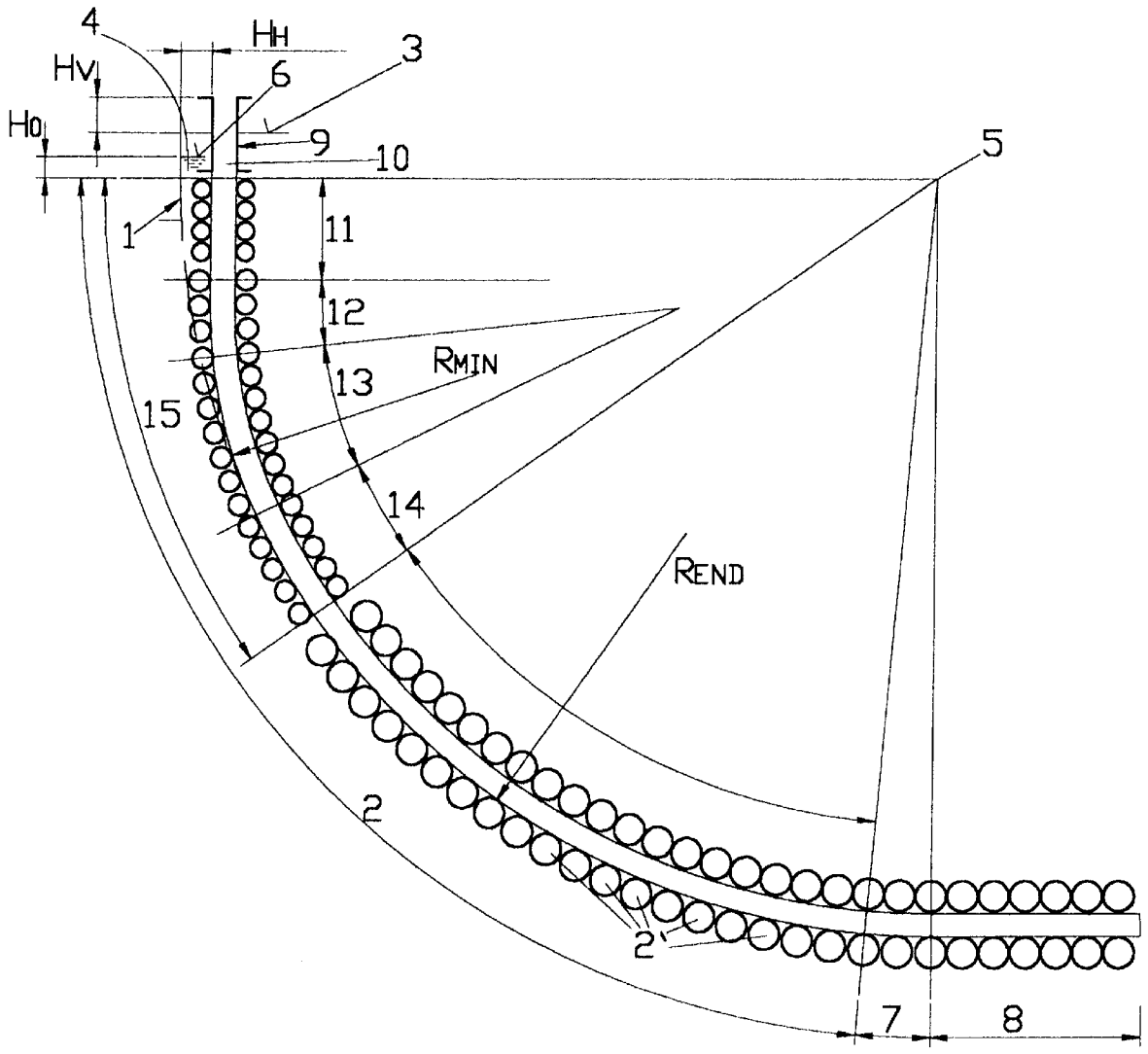
5
3
10
9
6
HH
4
HV
HO
1
11
12
13
14
15
RMIN
REND
2
2'
7
8

PROCESS FOR CONTINUOUSLY CASTING METAL AND CONTINUOUS CASTING APPARATUS USED THEREOF

BACKGROUND OF THE INVENTION

1. Field of the Invention

The invention relates to a process for continuously casting metal strands and, in particular, steel strands by casting the metal into a straight, vertically oriented mold and subsequently withdrawing the straight strand formed in the mold, wherein the straight strand at first is bent in a bending zone along a transition curve into a circular arc shape having a radius, is guided along a circular arc guide having said radius, subsequently is straightened in a final straightening zone along a transition curve and, after this, is extracted via an approximately horizontal straight guide, as well as a continuous casting apparatus for canrying out said process and a process for converting a continuous casting apparatus including a curved mold into a continuous casting apparatus including a straight mold.

2. Prior Art

It is known, for instance, from AT-B-373 518 and AT-B-331 439 to use a straight mold in order to produce a metal strand by the continuous casting method, i.e., a mold whose cavity receiving the liquid metal is designed straight and oriented in a vertical sense. After emergence from the mold, the strand is guided over a guide comprising a roller system installed either in supporting segments or in through going longitudinal carriers and cooled in a manner that the still thin strand skin is sufficiently supported against bulging caused by the ferrostatic pressure. In most cases, the strand below the mold initially is still guided by a straight guide extending over a length so as to impart on the strand a sufficiently solid strand shell due to direct cooling below the mold such that the strand may subsequently be bent in a bending zone in a manner so as to be able to be further conveyed along a circular arc guide following the bending zone and having a predetermined radius. After the circular arc guide follows a final straightening zone, in which the strand is straightened again. In the straight state, the strand is extracted via an approximately horizontally oriented straight guide.

It is, furthermore, known, for instance, from AT-B-249 896 to cast the strand already in a bent shape in a so-called curved mold in order to produce a metal strand by the continuous casting method, avoiding, a bending zone. In such a curved mold, the cavity into which the liquid metal is cast is arc-shaped and, preferably, circular arc-shaped such that the strand emerging from the mold can be supported and conveyed by a circular arc guide immediately upon its emergence. In that case, it will do to provide a final straightening zone at the end of the circular arc guide, in which the strand is straightened again so as to be subsequently extractable from an approximately horizontal straight guide, as described above.

Continuous casting plants comprising curved molds have been built worldwide; yet, such plants involve metallurgical drawbacks, which are to be seen primarily in that impurities and gas bubbles introduced by the casting jet and penetrating deeply into the strand core can no longer ascend to the meniscus as easily as in a straight mold. Besides, the flow ratios in a curved mold are less beneficial such that disturbances in the shell growth are quite likely to occur.

For the above reasons, attempts have been made to convert continuous casting apparatus including curved molds into continuous casting apparatus including straight molds. If, in doing so, the same strand guide is to be used as provided in the original curved mold continuous casting apparatus, one is forced to arrange a bending zone to precede the circular arc-shaped strand guide as well as a straight continuous casting mold in alignment above the same. However, this involves difficulties since the level of the straight mold will be far above the height of the originally provided curved mold. This is in acceptable, eventually requiring not only an enlargement of the casting hall, but also a redevelopment of the overall hall concept with the casting platform, intermediate vessels and ladle carrying tower as well as the ladle supplies etc. having to be adapted to that new level. As a result, the casting hall will have to be completely reorganized, which is accordingly expensive and, on the other hand, necessitates a long standstill of the casting operation.

Another option consists in replacing the circular arc guide with a circular arc guide adapted to the straight mold and consecutive bending zone. This is, however, also very cumbersome and expensive so that the metallurgical drawbacks of a curved mold will have to be put up with in most cases.

SUMMARY OF THE INVENTION

The invention has as its object to provide a continuous casting process as well as a continuous casting apparatus for carrying out said process, which enable casting of the strand using a straight mold and applying the most important components of a continuous casting apparatus including a curved mold such as, e.g., the circular arc guide, the casting platform, etc. Another aim of the invention consists in approximately keeping in a continuous casting apparatus including a straight mold, the structural height of a continuous casting apparatus including a curved mold at the same radius of the casting strand and the circular arc guide, respectively. Conversions required when changing from a curved mold to a straight mold are to be minimized in terms of both time and cost.

In a process for continuously casting a metal strand of the initially defined kind, this object is achieved in that the strand in at least one bending zone along a transition curve is bent into a circular arc shape having a first radius and in at least one consecutively arranged straightening zone along a transition curve is bent into a circular arc shape having a larger radius than the radius of the strand after the first bending zone, the larger radius preferably corresponding to the radius of the circular arc guide in front of the final straightening zone.

Preferably, the strand having a first radius between the first bending zone and the first consecutively arranged straightening zone is guided along a circular arc guide having said first radius, wherein the straight strand emerging from the mold advantageously is guided between the mold and the first bending zone along a vertical straight guide.

If the radius of the circular arc guide is very large, the strand, after having been bent in the first straightening zone following the bending zone, in at least one further consecutively arranged straightening zone suitably is bent into a circular arc shape having a larger radius than the radius of the strand in front of the consecutively arranged straightening zone.

According to a variant, in the event of large radii of the circular arc guide at least a further shaping of the strand may be effected in a further bending zone and consecutively arranged straightening zone, following shaping in the first bending zone and consecutively arranged straightening zone.

A continuous casting apparatus for carrying out the process according to the invention, comprising a straight mold, a strand guide following upon or downstream as said mold in the strand extraction direction and including a bending zone, a circular arc guide and a final straightening zone followed by a consecutively arranged, approximately horizontal straight guide is characterized in that at least one straightening zone followed by a consecutively arranged circular arc guide is arranged to follow at least one bending zone.

Advantageously, a circular arc guide is provided between the first bending zone and the first straightening zone, a vertical straight guide suitably being provided for the strand between the mold and the first bending zone.

According to a variant, at least one further bending zone followed by a straightening zone is arranged to follow the first bending zone and consecutively arranged straightening zone.

A preferred embodiment is characterized in that, according to AT-B-331 439, the strand elongation course caused by the bending zone(s) and straightening zones, respectively, in at least one of the two transitional regions approximately has the shape of an obliquely distorted "S" including an inflectional tangent, wherein the slopes at the beginning and end of the elongation curve plotted above said region are zero, based on the X axis of a cartesian coordinate system whose origin is each located in the beginning of the transition curve and whose X axis constitutes a tangent to the transition curve.

In that case, the inclination of the inflectional tangent suitably at most corresponds to a maximally admissible change of elongation of 0.0025%/mm during bending and 0.0030%/mm during straightening.

Preferably, the transition curve follows the differential equation of the change of curvature (y''')

$$y''' = \varphi'(x_j) \cdot \frac{1}{R_{E_0} X_E \int \varphi'(x_j) dx}$$

and $\phi'(x_j)$ is the function of the change of elongation, which, over the extension of the bending or straightening zone, has a course initially rising from zero, then reaching the maximum of the change of elongation and then dropping back to zero, $R_E$ is the radius of the circular arc at the end of the bending zone or beginning of the straightening zone, respectively, and $X_E$ is the vertical projection of the bending zone or the horizontal projection of the straightening zone, respectively, and $x_j$ represents a position coordinate within the coordinate system.

A process for converting a continuous casting apparatus including a curved mold, a circular arc guide following thereupon and a final straightening zone with a consecutively arranged, approximately horizontal straight guide, into a continuous casting apparatus including a straight vertically oriented mold is characterized in that the cured mold and a circular arc guide part following thereupon are removed, a straight mold is installed on a continuous casting apparatus site whose distance relative to the center of curvature of the circular arc guide is smaller than the radius of the original circular arc guide, a bending zone including a transition curve is installed in alignment with the straight mold, from which bending zone the strand having a first radius smaller than the radius of the circular arc guide emerges, and at least one straightening zone is installed to follow the bending zone, from which straightening zone the strand having a second radius larger than the first radius emerges, which second radius preferably corresponds to the radius of the part of the originally present circular arc guide remaining in the continuous casting apparatus and merges into this circular arc guide in an aligned, i.e., tangentially equal manner.

Suitably, a circular arc guide is installed between the bending zone and the first straightening zone.

According to a preferred variant, a straight guide registering with the mold is installed between the mold and the bending zone.

In order to do with not too excessive a bending of the strand, the straight mold advantageously is installed into the continuous casting apparatus on a level only slightly deviating from the level of the curved mold, preferably lying closely above said level, wherein the deviation from the level of the curved mold is a function of the height of the hall, the crane system installed, etc. A "small height deviation" usually serves to denote a deviation that enables the avoidance of a conversion of the hall structure in any event; as a rule, the height deviation in usually designed casting halls ranges between half a meter and one meter at the most.

In the event of large radii of the circular arc guide it has proved suitable to install a further straightening zone with a consecutive circular arc guide so as to follow the first straightening zone.

According to another variant, it is suitable in case of large radii of the circular arc guide, if at least one further bending zone with a consecutive straightening zone is installed so as to follow the first bending zone and consecutively arranged straightening zone.

BRIEF DESCRIPTION OF THE DRAWING

In the following, the invention will be explained in more detail by way of an exemplary embodiment illustrated in the drawing, the FIGURE showing a schematic side view of a continuous casting apparatus including a straight mold and a curved mold.

DETAILED DESCRIPTION OF A PREFERRED EMBODIMENT OF THE INVENTION

A curved mold 1 with a consecutively arranged strand guide 2 is illustrated in the FIGURE by broken lines, wherein in the illustration, for reasons of simplicity, the strand guide 2 in the upper region—i.e., immediately below the curved mold 1—is represented merely by a broken line indicating the external or lower side of the strand. As usual, this strand guide 2 is formed by supporting and guiding rollers 2' following upon the mold and supporting the strand at small distances on both sides, i.e., on the external or lower side and also on the internal or upper side. The lower or external side of the strand, which is illustrated by a broken line, thus constitutes an envelope of all of these rollers.

The casting platform 3 is located approximately on the level of the upper edge of the curved mold 1. The internal space 4 of the curved mold 1, i.e., the continuous cavity 4 receiving the metal melt, which via a usual casting ladle not illustrated streams into a likewise not illustrated, yet conventionally designed tundish and from there into the curved mold 1 via a casting tube, is designed to be arc-shaped, i.e., circular arc-shaped. The circular arc guide 2 following upon the curved mold 1 has a radius $R_{end}$. The center 5 of this circular arc guide is located approximately on the level of the lower half of the curved mold 1 and hence below the meniscus 6 of the curved mold 1 by about the height $H_0$.

The circular arc guide 2, which does not extend over a total quarter circular arc, is followed by a straightening zone 7, in which the strand is straightened by means of supporting and bending rollers. The straightening zone 7 advantageously comprises a transition curve as in accordance with AT-B-331 439 in order to ensure the careful straightening of the strand. Following the straightening zone 7 is provided an approximately horizontally oriented straight guide 8, which likewise comprises closely adjacent supporting and guiding rollers. The strand is conveyed outwards along this straight guide 8 and, after this, is separated into individual strand pieces or also rolled directly. The straight guide 8 also may deviate from the horizontal line; thus, deviations of 5°± from the horizontal are readily feasible.

The FIGURE in full lines depicts a continuous casting apparatus in which the curved mold 1 is replaced with a straight mold 9. As is apparent from the FIGURE, this straight mold 9 is arranged to be offset relative to the curved mold 1 in the direction towards the center 5 of the circular arc guide 2 by a horizontal amount $H_H$.

In addition, this straight mold 9 is offset relative to the curved mold 1 by a slight amount also in terms of height, i.e., by the height $H_v$. The straight mold 9, i.e., a mold 9 defining a vertically oriented and linear cavity 10 into which the metal melt is cast, is followed by a vertically oriented straight guide 11. This serves to safeguard a purely vertically oriented section of the cast strand ensuring efficient purification, i.e., rising of impurities and gas bubbles washed into the liquid core of the strand by the casting jet.

The vertical straight guide 11 is followed by a bending zone 12 including a transition curve along which the strand is bent from a rectilinear into a circular arc shape. Suitably, this transition curve likewise is configured in accordance with AT-B-331 439.

The circular arc shape has a radius $R_{min}$ smaller than the radius $R_{end}$ of the circular arc shape 2 provided for the curved mold 1. The bending zone 12 is followed by a circular arc guide 13 having a radius $R_{min}$ and extending only over a smaller radius angle of about 20°. The circular arc guide 13 is followed by a straightening zone 14 in which the strand is slightly straightened exactly to the radius $R_{end}$ of the circular arc guide 2 originally provided for the curved mold 1. $R_{min}$ is to be selected as a function of the material to be cast, the casting speed and the casting thickness (strand thickness). When choosing $R_{min}$ it is to be borne in mind that the strand skin will not be exposed to excessive loads (excessive changes of elongation) during first-time bending.

The nearer the straight mold 9 is shifted to the center of curvature 5, the more readily is it feasible for the straight mold 9—despite a relatively long straight guide 11—to keep a level 3 of the curved mold 1, yet at a decrease of $R_{min}$, particularly if a long vertical straight guide 11 is desired.

In this manner, it is feasible to get the strand from a straight mold 9 into the circular arc guide 2 of the curved mold without having to lift the straight mold 9 to a large extent. It is, thus, feasible by way of but a small conversion—only the first part 15 of the circular arc guide 2 departing from the curved mold 1 and extending as far as to the end of the newly provided straightening zone 14 need be removed—to take advantage of all of the metallurgical benefits offered by a straight mold. The tundish and the ladle carrying tower may be readily used further, optionally upon slight lifting. The casting hall itself is not affected at all.

It is apparent from the FIGURE that slight shortening of the vertical straight guide 11 which follows upon the straight mold 9 would suffice in order for the mold 9 to be located exactly on the level of the curved mold 1.

It is essential to the invention that the strand emerging from the straight mold 9 at first is bent to a radius $R_{min}$ smaller than the radius $R_{end}$ of the circular arc guide 2 of the curved mold 1 and only after this is bent to that radius $R_{min}$. Bending of the linear strand to the radius $R_{end}$ also may be effected in several steps, for instance by the consecutive arrangement of several straightening zones 14, but also by bending of the straight strand in a first bending zone 12 to a radius $R_{min}$ smaller than the radius $R_{end}$ of the circular arc guide, subsequent straightening to a slightly larger radius than $R_{min}$ exhibited by the strand when leaving the first bending zone, which procedure also may be repeated several times until the radius $R_{end}$ of the circular arc guide of the curved mold has been reached. Such variants including multi-stage straightening and/or multi-stage bending-straightening advantageously are to be applied if the straight mold 9 is to be located exactly on the level 3 of the removed curved mold 1.

What we claim is:

1. In a process for continuously casting a metal strand by casting metal into a straight vertically oriented mold so as to form a straight strand and subsequently withdrawing from said mold said straight strand formed in said mold, bending said straight strand in at least one bending zone means along a transition curve to obtain a circular arc-shaped strand having a circular arc radius, guiding said circular arc-shaped strand along a circular arc guide having said circular arc radius, subsequently straightening said circular arc-shaped strand in a final straightening zone means along a final straightening zone transition curve to obtain a straightened strand, and finally extracting said straightened strand via an approximately horizontal straight guide the improvement comprising forming said at least one bending zone means including a first transition curve and bending said strand along said first transition curve to a circular arc shape having a first circular arc radius, and providing at least one consecutively arranged straightening zone means including a second transition curve and bending said strand along said second transition curve to impart on said strand a circular arc shape having a second circular arc radius larger than said first circular arc radius exhibited by said strand after being bent to said circular arc shape of said first transition curve.

2. A process as set forth in claim 1, wherein said second circular arc radius corresponds to said circular arc radius of said circular arc guide preceding said final straightening zone means.

3. A process as set forth in claim 1, further comprising providing a circular arc guide having said first circular arc radius between the first one of said bending zone means and said at least one of said consecutively arranged straightening zone means and guiding said strand having said first circular arc radius between said first one of said bending zone means and said first one of said consecutively arranged straightening zone means along said circular arc guide.

4. A process as set forth in claim 1, further comprising providing a vertical straight guide between said mold and the first one of said bending zone means and guiding said straight strand emerging from said mold along said vertical straight guide.

5. A process as set forth in claim 1, further comprising providing at least one further consecutively arranged straightening zone means and, after bending said strand in the first one of said straightening zone means following said bending zone means bending said strand to a circular arc shape having a circular arc radius larger than said first circular arc radius exhibited by said strand upstream of said further consecutively arranged straightening zone means.

6. A process as set forth in claim 1, further comprising providing a further bending zone means and consecutively arranged straightening zone means and subjecting said strand after shaping in the first one of said bending zone means and consecutively arranged straightening zone means to at least a further shaping in said further bending zone means and consecutively arranged straightening zone means.

7. In a continuous casting apparatus for continuously casting a metal strand, including a straight vertically oriented mold constructed to receive metal to form a straight strand and a strand guide downstream of said mold in the extraction direction of said metal strand and including a circular arc guide having a circular arc radius, a final straightening zone means and an approximately horizontal straight guide, the improvement comprising at least one bending zone means including a first transition curve arranged in said strand guide downstream of said mold in the extraction direction of said metal strand and constructed to bend said straight strand after extraction from said mold along said first transition curve to obtain a circular arc-shaped strand having a first circular arc radius, and at least one straightening zone means including a second transition curve downstream of said at least one bending zone means and constructed to bend said strand along said second transition curve to obtain a circular arc-shaped strand having a second circular arc radius larger than said first circular arc radius.

8. A continuous casting apparatus as set forth in claim 7, further comprising a circular arc guide provided between the first one of said bending zone means and the first one of said straightening zone means.

9. A continuous casting apparatus as set forth in claim 7, further comprising a vertical straight guide provided for said metal strand between said mold and the first one of said bending zone means.

10. A continuous casting apparatus as set forth in claim 7, further comprising at least one further bending zone means with a consecutively arranged straightening zone means downstream of the first one of said bending zone means and consecutively arranged straightening zone means.

11. A continuous casting apparatus as set forth in claim 7, wherein a strand elongation course imparted on said metal strand by said at least one bending zone means and straightening zone means in at least one transition region of said first and second transition curves approximately has the shape of an obliquely distorted "S" including an inflectional tangent, wherein the slopes at the beginning and end of said elongation curve plotted above said at least one transition region are zero, based on the X axis of a Cartesian coordinate system whose origin is each located in the beginning of each one of said transition curves and whose X axis constitutes a tangent to the respective one of said transition curves.

12. A continuous casting apparatus as set forth in claim 11, wherein said inflectional tangent has an inclination which at most corresponds to a maximally admissible change of elongation of 0.0025%/mm during bending and 0.0030%/mm during said straightening.

13. A continuous casting apparatus as set forth in claim 12, wherein each of said transition curves follows a change of curvature differential equation $$y''' = \varphi'(x_j) \cdot \frac{1}{R_{E_0} X_E \int \varphi'(x_j) dx}$$

and $\phi'(x_j)$ is a change of elongation function, which over the extension of said bending and straightening zone means has a course initially rising from zero, then reaching the maximum change of elongation and then dropping back to zero, $R_E$ is the radius of the circular arc at the end of said bending zone means and beginning of said straightening zone means, $X_E$ is the vertical projection of said bending zone means and horizontal projection of said straightening zone means, and $x_j$ represents a position coordinate within said coordinate system.

14. A process for converting a continuous casting apparatus including a curved mold, a first circular arc guide downstream of said curved mold and a final straightening zone means with a consecutively arranged approximately horizontal straight guide for extracting said straightened strand, into a continuous casting apparatus including a straight vertically oriented mold, which process comprises the steps of a. removing from said continuous casting apparatus said curved mold and first circular arc guide downstream thereof, b. installing a straight mold on said continuous casting apparatus whose distance relative to the center of curvature of said first circular arc guide is smaller than the distance from said center of curvature to said removed curved mold, c. installing at least one bending zone means including a first transition curve in alignment with said straight mold for a cast strand to emerge with a first circular arc radius smaller than the circular arc radius of the circular arc guide as originally provided, and d. installing at least one straightening zone means downstream of said bending zone means for said cast strand to emerge with a second circular arc radius larger than said first circular arc radius.

15. A process as set forth in claim 14, further comprising a further circular arc guide downstream of said straightening zone means, wherein said second circular arc radius corresponds to the radius of said further circular arc guide and merges into said further circular arc guide in a tangential manner.

16. A process as set forth in claim 14, further comprising installing a circular arc guide between the first one of said bending zone means and the first one of said straightening zone means.

17. A process as set forth in claim 14, further comprising installing a straight guide registering with said mold between said mold and the first one of said bending zone means.

18. A process as set forth in claim 14, wherein said straight mold is installed into said continuous casting apparatus on a level only slightly deviating from the level of said curved mold.

19. A process as set forth in claim 14, wherein said straight mold is installed into said continuous casting apparatus on a level lying closely above the level of said curved mold.

20. A process as set forth in claim 14, further comprising installing a further straightening zone means with a consecutively arranged circular arc guide downstream of said first straightening zone means.

21. A process as set forth in claim 14, further comprising installing at least one further bending zone means with a consecutively arranged straightening zone means downstream of said first bending zone means and consecutively arranged straightening zone means.

22. A process for continuously casting a metal strand comprising the steps applied continuously:

a. casting metal into a straight vertically oriented mold forming a straight strand, b. subsequently withdrawing said straight strand from said mold, c. then bending said straight strand in a bending zone along a first transition curve so as to impart on said strand a circular arc having a first circular radius R1, d. then straightened said strand having said circular arc of radius R1 in a first straightened zone along a second transition curve for imparting on said strand a second circular arc of radius R2, where R2 is greater than R1, e. subsequently straightening said circular arc-shaped strand in a second straightening zone along a straightening zone transition curve so as to obtain a straightened strand, and f. finally extracting said straightened strand via an approximately horizontal straight guide.

23. A process according to claim 22 comprising the further step between said bending and first staightening zones of guiding said circular arc-shaped strand along a circular arc guide having circular radius R1.

24. A continuous casting apparatus for continuously casting a metal strand comprising a. a straight vertically oriented mold forming a straight strand, b. a strand guide for receiving and bending said strand from said mold, said apparatus comprising at least one bending zone means which bends and imparts on said strand a circular arc having a first circular radius, R1, c. a first straightened device zone which bends and imparts to said strand a second circular arc of radius R2, where R2 is greater than R1, d. a second straightening zone device which straightens and extracts said strand via an approximately horizontal straight guide.

25. A process for continuously casting a metal strand comprising the steps applied continuously:

(a) casting metal into a straight vertically oriented mode forming a straight strand, (b) guiding the straight strand from the mold, (c) bending the straight strand to a first circular arc of radius R1 in a first bending zone, (d) then straightening the strand from the circular arc of radius R1 to a second circular arc of radius R2, where R2 is greater than R1.

(e) then guiding the strand along a second transition curve of radius R2, where R2 is greater than R1, (f) subsequently straightening the circular arc shaped strand along a straightened zone transition curve to obtain a straightened strand, and (g) finally extracting the straightened strand via a straight guide.

* * * * *